US005402097A

United States Patent [19]

Chou

[11] Patent Number: 5,402,097

[45] Date of Patent: Mar. 28, 1995

[54] RING COIL WINDING ASSISTING DEVICE

[76] Inventor: Daniel Chou, 2 Fl., No. 2, Lane 37, Ming Yuan Str., San Chung City, Taipei Hsien, Taiwan, Prov. of China

[21] Appl. No.: 104,631

[22] Filed: Aug. 11, 1993

[51] Int. Cl.[6] ..... H01F 15/10; H01F 27/30

[52] U.S. Cl. ..... 336/192; 336/198; 336/229

[58] Field of Search ..... 336/229, 192, 90, 92, 336/100, 198, 208

[56] References Cited

U.S. PATENT DOCUMENTS

| | | | |
|---|---|---|---|
| 2,290,680 | 7/1942 | Franz | 336/229 |
| 3,008,108 | 11/1961 | Baker et al. | 336/229 |
| 3,068,381 | 12/1962 | Vazquez | 336/229 |
| 4,763,072 | 8/1988 | Katoh et al. | 336/229 |

FOREIGN PATENT DOCUMENTS

| | | | |
|---|---|---|---|
| 1350868 | 12/1963 | France | 336/229 |
| 653628 | 3/1979 | U.S.S.R. | 336/229 |

*Primary Examiner*—Thomas J. Kozma
*Attorney, Agent, or Firm*—Bacon & Thomas

[57] ABSTRACT

A ring coil winding assisting device for winding with an enamel wire to form into a ring coil, consisted of two symmetrical annular insulation shields and an iron core insulated in between, one insulation shield having a projecting stator at the top in parallel with the central axis of the iron core for fastening one end of the enamel wire to be wound, the stator having a circularly smooth ridge around the periphery for passing the enamel wire during its winding.

4 Claims, 5 Drawing Sheets

2

RING COIL WINDING ASSISTING DEVICE

BACKGROUND OF THE INVENTION

The present invention relates to a device for use in making a ring coil by an automatic winding machine.

The number of turns of the ring coil of an electrical device such as transformer or inductance may be several thousands. Before the invention of automatic coil winding machines, it took about one working day to finish the winding of a ring coil. The use of an automatic coil winding machine greatly improves the production speed of ring coils. A ring coil is normally made by winding an enamel wire round an insulated annular iron core. The insulation between the annular iron core and the winding of enamel wire is now commonly consisted of two symmetrical annular insulation shields attached together to hold the annular iron core in between. Although the use of an automatic coil winding machine greatly improves the winding speed of ring coils, there are still problems to be settled. Because the leading end of the enamel wire is not fixed, it will be forced to displace as the enamel wire passes over after each run of winding (360×around the central axis). If the leading end of the enamel wire is displaced, the quality and service life of the ring coil will be affected. In order to eliminate this problem, the automatic coil winding machine must be temporarily stopped to let the enamel wire be moved over the leading end with the hand each time the enamel wire is wound round the ring coil insulation shield through 360×around the central axis of the annular iron core and reached the leading end again.

SUMMARY OF THE INVENTION

The present invention has been accomplished under the aforesaid circumstances. It is therefore the principal object of the present invention to provide a ring coil winding assisting device which allows the leading end of the enamel wire to be fastened in place during the winding of the ring coil. It is another object of the present invention to provide a ring coil winding assisting device which greatly improves the winding process of ring coils. These objects are achieved by making a projected stator on the upper annular insulation shield for fixing the leading end of the enamel wire, and a circularly smooth ridge around the periphery of the stator for passing the enamel wire.

DETAILED DESCRIPTION OF THE PREFERRED EMBODIMENTS

Figure 1:
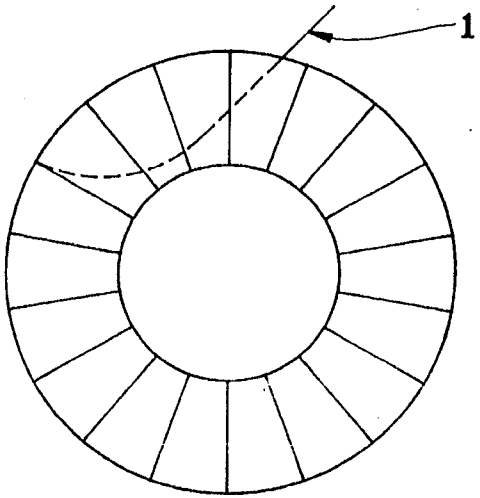
Fig. 1 PRIOR ART
FIG. 1 illustrates the layout of the winding of a ring coil according to the prior art.
Figure 2:
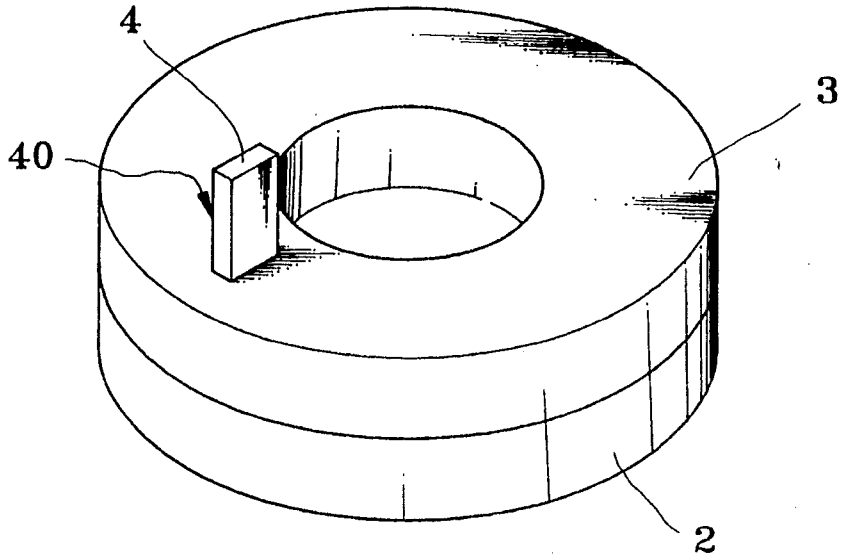
FIG. 2 is a perspective view of a ring coil winding assisting device according the present invention.

Referring to FIG. 2, a ring coil winding assisting device in accordance with the present invention is generally comprised of an annular iron core (not shown), and two symmetrical, annular insulation shields 2;3 surrounding the annular iron core. The insulation shields 2;3 insulate the annular iron core from the enamel wire. One insulation shield 2 or 3 comprises a projected stator 4 disposed in parallel with the central axis of the iron core for the positioning of the leading end 1 (see FIG. 7). After the winding, the top of the stator 4 is disposed in flush with the coil winding.

Figure 3:
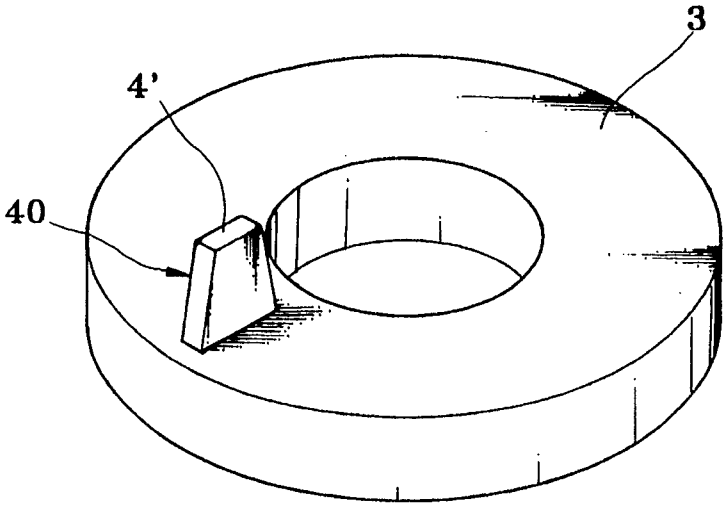
FIG. 3 is a perspective view of an alternate form of the ring coil winding assisting device of the present invention.
Figure 4:
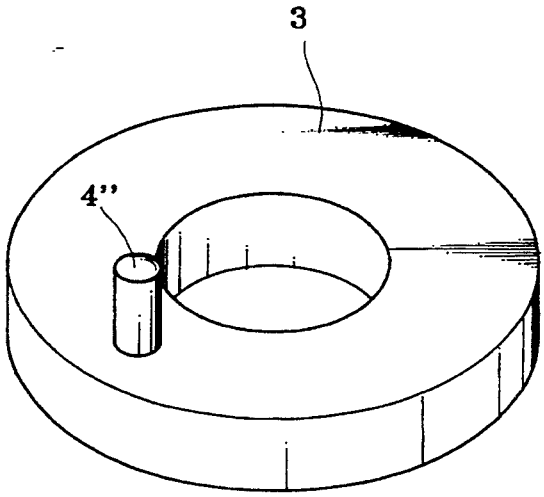
FIG. 4 is a perspective view of another alternate form of the ring coil winding assisting device of the present invention.

Referring to FIGS. 3 and 4, and FIG. 2 again, the shape of the stator 4 may be variously embodied according to the diameter of the enamel wire. When a thinner enamel wire is used, the stator 4 can be made in the shape of a round rod (see FIG. 4). If a thicker enamel wire is used, the stator 4 can be made in the shape of a rectangular block (see FIG. 2) or a trapezoidal block (see FIG. 3) to increase drag stress.

Figure 5:
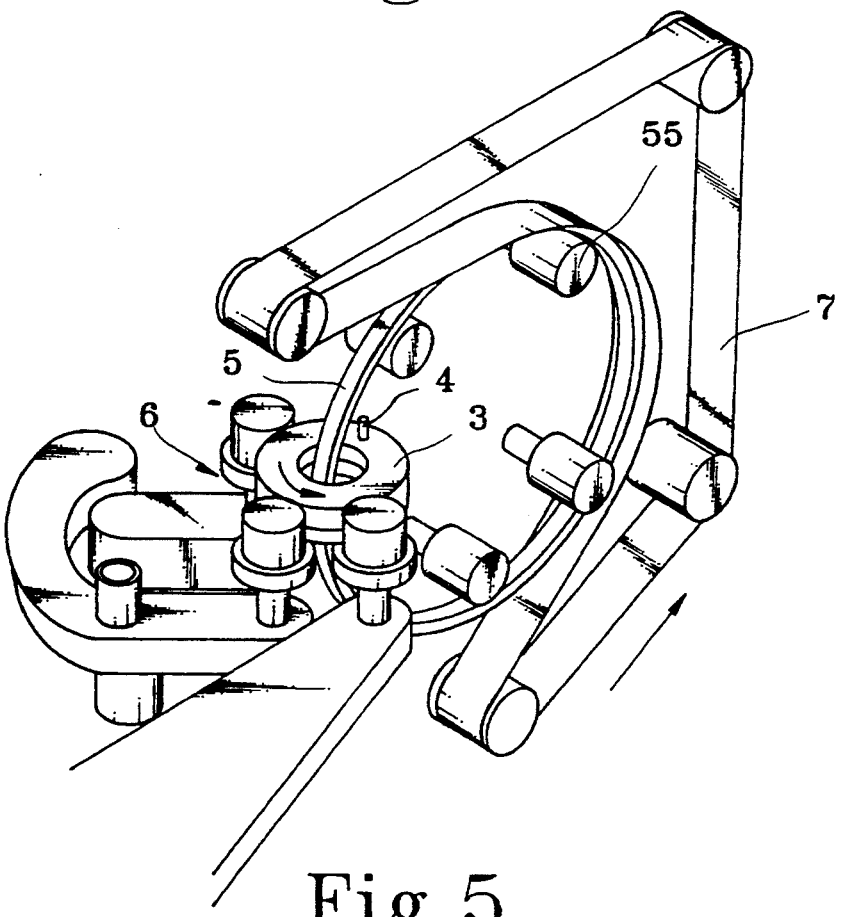
FIG. 5 is an installed view showing a ring coil winding assisting device of the present invention installed in an automatic winding machine.
Figure 9:
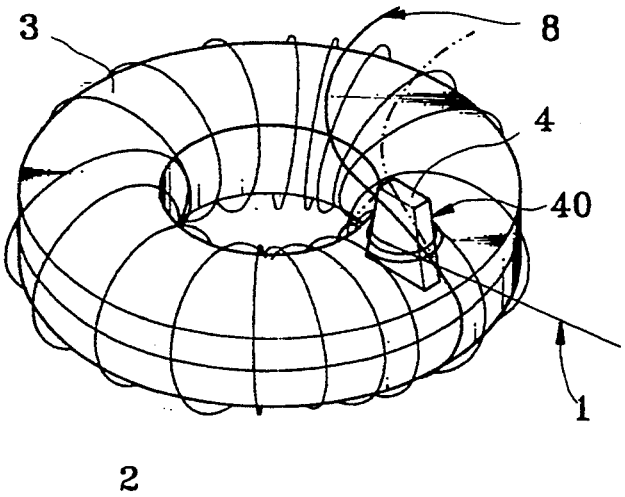
FIG. 9 shows the enamel wire passed over the ridge of the stator.
Figure 6:
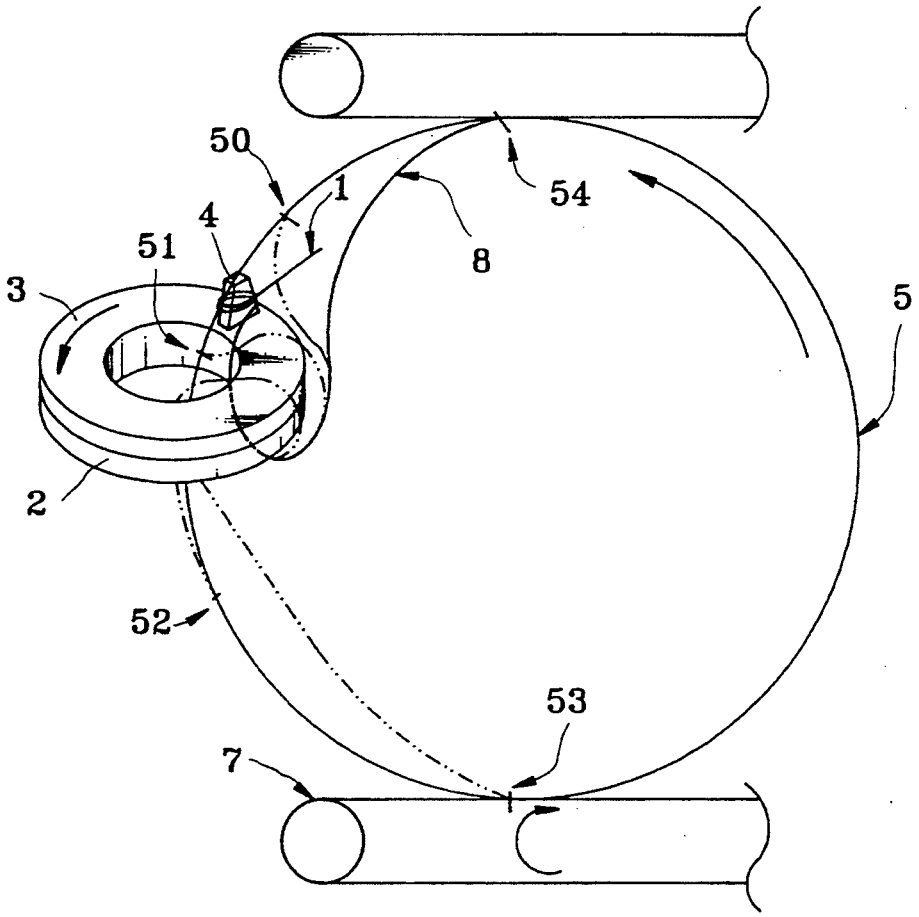
FIG. 6 is a schematic drawing showing the enamel wire wound round the ring coil winding assisting device through one turn.

Referring to FIG. 5, therein illustrated showing the ring coil winding assisting device installed in an automatic winding machine for winding with an enamel wire to form into a ring coil. The ring coil winding assisting device is retained in a horizontal position within three clamping wheels 6, and mounted around an enamel wire feed rack 5. The enamel wire feed rack 5 is mounted around four equiangularly spaced rollers 55, and driven by a toothed driving belt 7. The enamel wire feed rack 5 is made in the shape of an open loop having a gap through which the ring coil winding assisting device can be conveniently mounted around the enamel wire feed rack 5.

Figure 7:
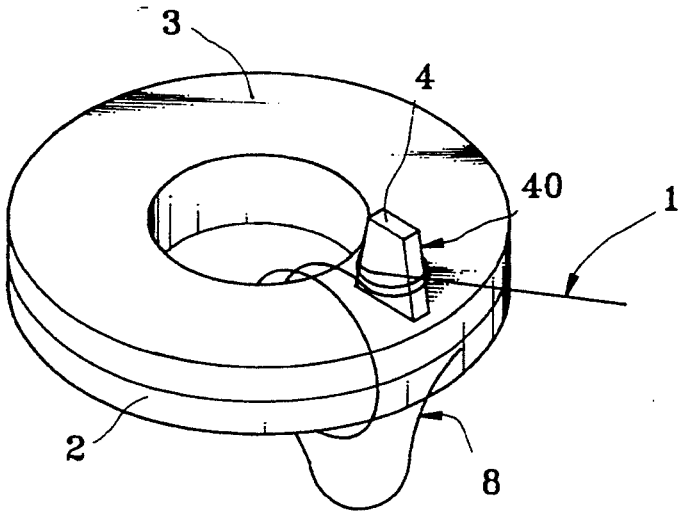
FIG. 7 shows the winding direction of the enamel wire on the ring coil winding assisting device.
Figure 8:
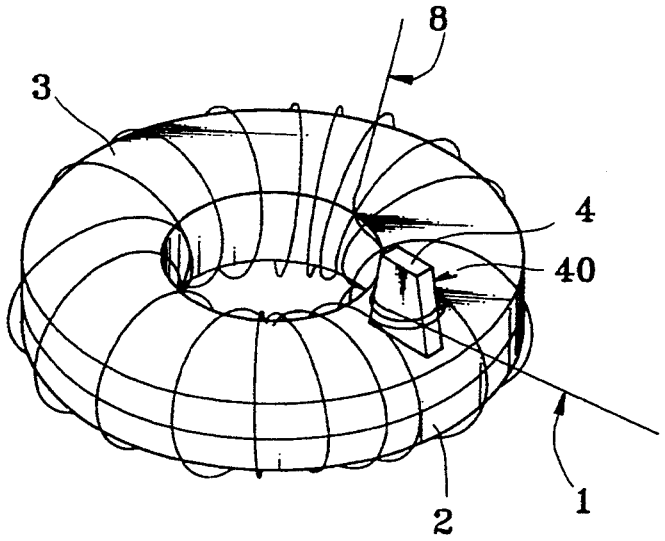
FIG. 8 shows the enamel wire wound round the ring coil winding assisting device through one circle.

Referring to FIGS. 6, 7, 8, and 9, the the enamel wire 8 is inserted through the center hole of the ring coil winding assisting device from the bottom, then wound round the ring coil winding assisting device for one turn, and then wound round the stator 4 with the leading end 1 of the enamel wire 8 left at a suitable length (see FIG. 7). As the leading end 1 is set, the automatic winding machine is started to turn the enamel wire feed rack 5 counter-clockwise (see FIG. 6). As the enamel wire feed rack 5 is rotated, the enamel wire 8 is guided out of the enamel wire feed rack 5 and moved through points 50;51;52, therefore the enamel wire 8 becomes loosely wound round the ring coil winding assisting device. As the lead wire is moved to point 53, the toothed driving belt 7 presses the enamel wire 8 on the outside surface of the enamel wire feed rack 5, therefore the enamel wire 8 is stretched as it is moved from point 53 to point 54. Therefore, the enamel wire 8 is being continuously wound round the ring coil winding assisting device around a circle as the enamel wire feed rack 5 is being continuously turned round and round (see FIG. 8). As the enamel wire 8 is being approximately wound round the ring coil winding assisting device through one circle, it is moved to the stator 4 again. As this very moment, the enamel wire 8 will be moved over a ridge 40 on the stator 4 to pass through the opposite side of the stator 4 (see FIG. 9). The ridge 40 must be made smooth so as not to damage the outer layer of the enamel wire 8. A smooth ridge on the stator can be easily achieved during the injection molding process of the annular insulation shield.

As indicated, the stator 4 allows the leading end 1 of the enamel wire 8 to be fixed in place, therefore the leading end 1 of the enamel wire 8 does not displace during the winding process. Further, the smooth ridge 40 on the stator 4 helps the enamel wire 8 pass over the training end 1, for allowing the winding process to be continuously operated.

While only few embodiments of the present invention has been shown and described, it will be understood that various modifications and changes could be made without departing from the spirit and scope of the invention.

I claim:

1. A ring coil having an annular iron core extending about a central axis comprising:

a) first and second annular insulation shields surrounding the annular iron core;

b) a single stator projecting from one of the first and second annular insulation shields in a direction parallel to the central axis, the single stator having a distal end; and c) an insulated wire wrapped around the first and second insulation shields in toroidal configuration, the insulated wire having an end attached to the single stator, and an outer surface of the wire toroid being substantially flush with the distal end of the single stator.

2. The ring coil of claim 1 wherein the single stator has a substantially cylindrical configuration.

3. The ring coil of claim 1 wherein the single stator has a truncated triangular configuration.

4. The ring coil of claim 1 wherein the single stator has a rectangular configuration.

* * * * *